US005272792A

United States Patent [19]

Harper

[11] Patent Number: 5,272,792

[45] Date of Patent: Dec. 28, 1993

[54] PAPER CLIP

[76] Inventor: Matthew C. Harper, 30423 Canwood St., Suite 231, Agoura Hills, Calif. 91301

[21] Appl. No.: 948,445

[22] Filed: Sep. 22, 1992

[51] Int. Cl.[5] ..... B42F 1/00

[52] U.S. Cl. ..... 24/67 CF; 24/67 R; 24/67.9

[58] Field of Search ..... 24/67 CF, 67 R, 67.9, 24/67.3; 46/158.1

[56] References Cited

U.S. PATENT DOCUMENTS

| | | | |
|---|---|---|---|
| 524,647 | 8/1894 | Pancoast | 24/67 CF |
| 1,423,520 | 7/1922 | Freedman | 24/67 CF |
| 2,323,653 | 7/1943 | Fowler, Jr. | 24/67 CF |
| 2,418,421 | 4/1947 | Murray | 24/67 CF |
| 2,728,451 | 12/1955 | Leander | 24/67.9 |
| 3,294,229 | 12/1966 | McConnell et al. | 24/67.9 |
| 4,148,114 | 4/1979 | Wier | 24/67.9 |

FOREIGN PATENT DOCUMENTS 0080900 10/1894 Fed. Rep. of Germany ... 24/67 CF

*Primary Examiner*—Victor N. Sakran

*Attorney, Agent, or Firm*—Jack C. Munro

[57] ABSTRACT

A paper clip to secure a plurality of sheets of paper which are located in juxtaposition. The paper clip includes a rigid sheet material metallic body which is bendable and when bent remains in the bent position. The body is to be bent into a pair of wings of substantially equal size that are to be located against the back side of the sheets of paper with the sheets of paper being bound between the wings and the front of the body. These wings are to be bent over toward the front clamping the sheets of paper between the wings and the front. The body includes a plurality of ridges for tightly pressing the sheets of paper facilitating securement. The body can be manufactured in any one of variety of colors.

4 Claims, 1 Drawing Sheet

PAPER CLIP

BACKGROUND OF INVENTION

1) Field of Invention

The field of this invention relates to fasteners and more particularly to a fastener for a plurality of sheets of paper which are located in juxtaposition.

2) Description of Prior Art

The use of paper clips or paper fasteners have long been known. A typical paper clip is made of wire with a plurality of sheets of paper to be located between different sections of the wire clip thereby binding the sheets of paper together. Other types of paper fasteners have long been known such as fasteners which punch aligned holes through the pieces of paper with some type of metallic or string type of fastening arrangement being located through the hole. However, this particular type of arrangement has the undesirable feature of mutilating the sheets of paper which is not particularly attractive when used in conjunction with business letters or legal documents.

Still another exceedingly common used paper fastener is referred to as staple. The staple actually punctures through the sheets of paper and when punctured is bent over on itself binding the sheets of paper together. The staple works most satisfactorily. However, a staple is not a particularly attractive paper fastener. Also the staple utilizes the undesirable feature of puncturing the sheets of paper forming holes.

In the past it has been known to make paper fasteners or paper clips out of sheet metal while the sheet metal is capable of being bent and when bent will stay in the bent configuration. These prior types paper fasteners are to be applied to a corner of a stacked series of polygonal shaped sheets of paper. These types of paper fasteners have the advantage of not puncturing or defacing the sheets of paper. However, in the past these types of paper fasteners have not been particularly attractive and for that reason have never experienced any wide scale usage. Typical such fasteners are shown within the U.S. Pat. No. 524,647; 1,423,520; 1,146,591; 2,460,650 and 2,728,451.

SUMMARY OF INVENTION

The structure of the present invention is directed to a paper clip constructed of a sheet material metallic body which is basically rigid in shape but is capable of being bent and when bent will remain in the bent position. The body is primarily of a rectangular or square configuration with the exception that one side may be rounded and this one side will become the front of the clip to be placed against the front side or outer side of the sheets of paper that are to be secured together. Squared corner sections of the body are to be bent over against the remaining portion of the body forming wings which are to be located against the back side or back surface of the sheets of paper. The body is then further bent so that the outer surface of the wings will then be placed against the back surface of the sheets of paper binding the sheets of paper between the inside surface of the front of the body and the outside surface of the wings. Both the wings and the front include deformations which stresses the metallic body to increase the strength of the body and which function to tightly press the sheets of paper to facilitate securement of the sheets of paper. The entire body of the clip is to be constructed in any one of the variety of colors with the user being capable of selecting any desired color.

The primary objective of the present invention is to construct a paper clip or paper fastener which will function to hold a substantial number of sheets together in a secure manner.

A further objective of the present invention is to construct a paper clip which is exceedingly attractive in appearance thereby being an attractive addition to any papers to which it is attached.

Another objective of the present invention is to construct a paper clip or paper fastener which is capable of including a personalization logo or advertizing indicia.

DETAILED DESCRIPTION OF THE SHOWN EMBODIMENT

Figure 1:
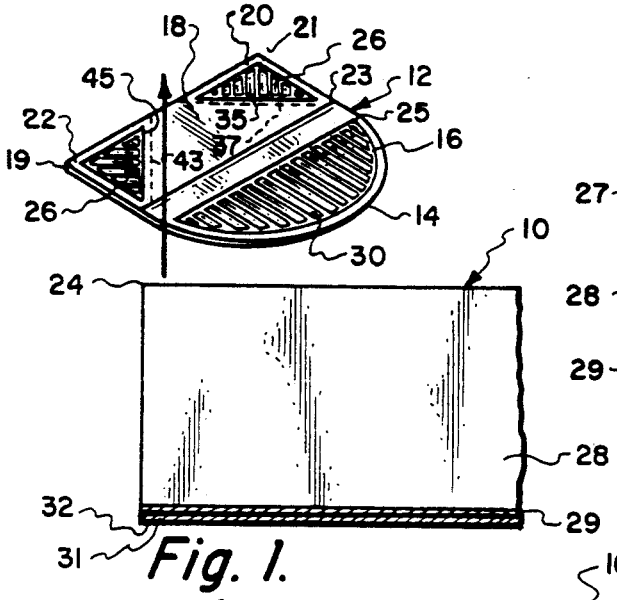
FIG. 1 shows a plurality of sheets of paper with the paper clip of the present invention about to be connected thereto.
Figure 4:
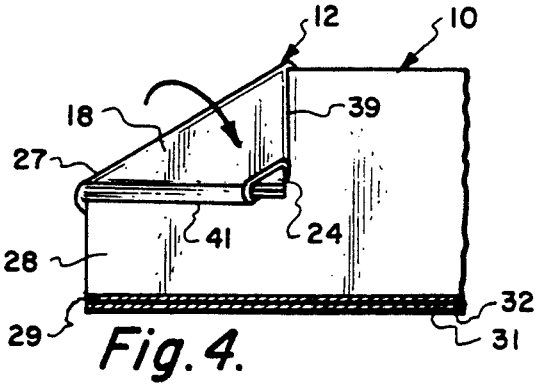
FIG. 4 is a view of the back side now showing the paper clip with the wings being moved over against the back side of the paper clamping the sheets of paper between the front and the wings.
Figure 2:
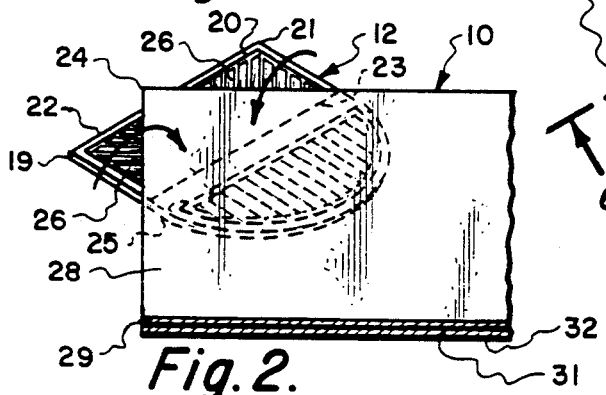
FIG. 2 is the back side of the sheets of paper of FIG. 1 depicting the forming of the body of the paper clip in a manner to form the wings.
Figure 5:
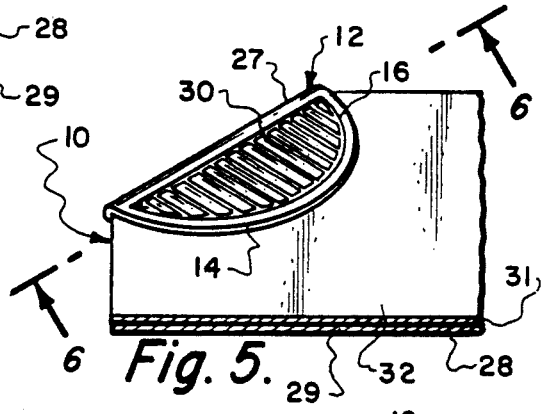
FIG. 5 is a view of the paper clip of the present invention from the front of its installed position which was attained within FIG. 4.

Referring particularly to the drawing, there is shown a stacked series of sheets of paper 10. These sheets of paper will generally will be of the same size and will be located in juxtaposition in a stacked relationship. Generally there will be no more than two to five sheets of paper. However, it is considered to be within the scope of this invention that the paper clip 12 of this invention could be utilized with even a greater number of sheets of paper 10.

The paper clip 12 will normally be constructed of aluminum, steel, tin or other similar type of metal. The paper clip 12 generally comprises a basic retangularly shaped body with the exception that what will be the front of the body will normally be rounded forming a dome 14. The body of the paper clip 12 is defined by a front 16 and a back 18. There is a main crease area 27 formed by a pair of score lines 23 and 25. This pair of score lines 23 and 25 functions to provide sufficient space to accommodate the thickness of several sheets of paper 10.

The back 18 has a pair of corners 19 and 21 which are to be bent over upon the back 18 forming wings 20 and 22. These wings 20 and 22 are about the same size and are located in conjunction with a corner 24 of the sheets of paper 10 with the corner 24 being aligned with the gap area 33 located between the wings 20 and 22. Between wing 20 and the remaining section of the back 18 is a short crease area 39 defined by a pair of score lines 35 and 37. Also, between wing 22 and the remaining section of back 18 is a short crease area 41 defined by a pair of score lines 43 and 45. There may be used only a single line for score lines 35 and 37 and for score lines 43 and 45. However, it has been found that maximum pressure is obtained within the clip 12 using the double score line arrangement. The distance between the score lines 35 and 37, and 43 and 45 can be varied to accommodate various thickness of installation due to a greater or lesser number of sheets of paper 10.

Each of the wings 20 and 22 include a mass of ridges 26 which tightly press into this corner area 24 of the sheets of paper 10. These ridges 26 function to create a secure binding action positively securing together the sheets of paper 10 preventing accidental dislogement of the sheets of paper 10 during normal usage. These ridges 26 are parallel within wing 20 and within wing 22. These ridges are oriented so their longitudinal dimension is perpendicular to score lines 35 and 37 and perpendicular to score lines 43 and 45. This arrangement strengthens each of the wings so bending always will occur only at the weakest point which is at short crease areas 39 and 41. It is noticed that score lines 35 and 37 are oriented perpendicular to score lines 43 and 45. It is considered to within the scope of the invention to use strengthening hiatuses other than lineal ridges 26 such loops, jagged lines, and so forth.

Figure 3:
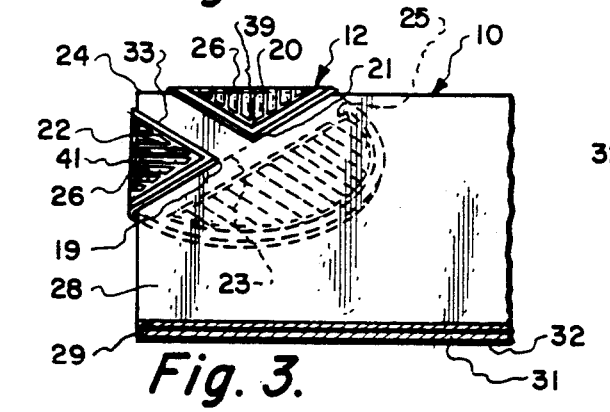
FIG. 3 is a view of the back side of the sheets of paper showing the wings in the initial installed position.
Figure 7:
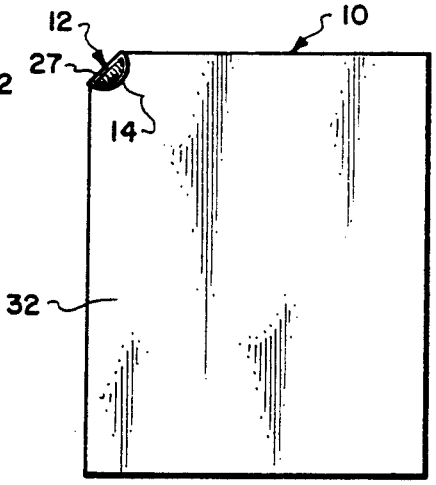
FIG. 7 is view of the front or outerside of the entire stacked series of sheets of paper upon which the paper clip of the present invention is installed.
Figure 6:
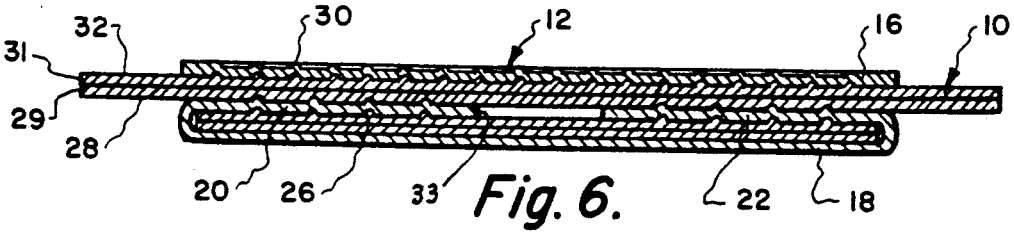
FIG. 6 is a cross-sectional view taken along line 6—6 of FIG. 5.

With the wings 20 and 22 so located as in FIG. 3 of the drawing, the user then manually bends the body of the paper clip 12 so that the outer surface of each of the wings 20 and 22 will be pressed against the back side 28 of the sheets of paper 10. This will cause a clamping action to occur between the front 16 and the wings 20 and 22 with the ridges 2 pressing into the sheets 10 of paper bound there between. To further assist in the securing procedure, the front 16 may include a mass of ridges 30 which will also tightly press into the front side of 32 of the sheets of paper 10. The longitudenal dimension of the ridges 30 is to be perpendicular to score lines 23 and 25 to also add strength to the front 16. The ridges 26 and 30 will normally be created during manufacturing of the clip 12 by embossing.

The paper clip 12 of this invention can be disengaged from the sheets 10 of paper and reinstalled on a second set of sheets 10 of paper if such is deemed to be desired. It has also been understood that the paper clip 12 will be manufactured in numerous colors such as gold, blue, green and yellow. A particular color of clip 12 could be used to denote a particular type of document. However, merely randomly using the different colors with letters and other similar type documents becomes an attractive addition to the papers that have been created. It is also to be considered to be within the scope of this invention that the exterior of the front 16 could be embossed or imprinted either directly or through the addition of a separate label with advertising indicia or with an individuals or corporate personalization identity logo. Although the paper clip 12 will normally be utilized on sheets 10 that are of the same size, it is considered to be within the scope of this invention to use the paper clip 12 on sheets 10 that are of different sizes. The body of the paper clip 12 can be unbent to be reused.

What is claimed is:

1. In combination with a plurality of sheets of paper located in juxtaposition, each said sheet of paper having a front side upon which indicia is generally located and a back side where generally no indicia is located, each said sheet of paper being polygonal having a plurality of corners, a paper clip to secure together said sheets of paper, said paper clip located at said corner, said paper clip comprising:

a rigid sheet material metallic body being manually bendable and will remain in an established bent position, said body having a front and a back, said front being located against a said front side, said back being located against a said back side, said back including in part a pair of spaced apart wings with there being a short crease area formed between each said wing and the remaining portion of said back, each said short crease area being formed of a pair of parallel, spaced apart, score lines to facilitate secure attachment of said wings to various thicknesses of said sheets of paper, said wings being bent toward said front binding said sheets of paper between said wings and said front with a main crease area being formed between said front and said back, said main crease area being formed of a pair of parallel, spaced apart, score lines to facilitate secure attachment of said paper clips to various thicknesses of said sheets of paper, and said wings including a plurality of first elongated ridges for tightly pressing said sheets of paper to facilitate securement.

2. The combination as defined in claim 1 wherein:

said first elongated ridges being parallel within each said wing, each said first elongated ridge being perpendicular to its respective said short crease area to obtain increased strengthening characteristics within each said wing.

3. The combination as defined in claim 2 wherein;

said front including a second series of elongated ridges for tightly pressing said sheets of paper to facilitate securement, said second elongated ridges being parallel, each said second elongated ridge being perpendicular to said main crease area.

4. The combination as defined in claim 3 wherein:

said metallic body being constructed in a variety of colors with there being a single color for a single said metallic body.

* * * * *